United States Patent [19]

Watanabe

[11] Patent Number: 4,739,634

[45] Date of Patent: Apr. 26, 1988

[54] CYLINDRICAL COUNTER-FLOW HEAT EXCHANGER

[75] Inventor: Yutaka Watanabe, Yokohama, Japan

[73] Assignee: Kabushiki Kaisha Toshiba, Kawasaki, Japan

[21] Appl. No.: 4,575

[22] Filed: Jan. 20, 1987

[30] Foreign Application Priority Data

Jan. 20, 1986 [JP] Japan ..... 61-9092

[51] Int. Cl.[4] ..... F25B 19/00

[52] U.S. Cl. ..... 62/514 JT; 165/169

[58] Field of Search ..... 62/514 JT; 165/169

[56] References Cited

U.S. PATENT DOCUMENTS

| | | | |
|---|---|---|---|
| 2,940,734 | 6/1960 | Harvey | 165/169 |
| 3,457,730 | 7/1969 | Berry et al. | 62/514 JT |
| 3,557,868 | 1/1971 | Burkell | 165/169 |
| 3,739,842 | 6/1973 | Whalen | 165/169 |
| 4,484,458 | 11/1984 | Longsworth | 62/514 JT |

FOREIGN PATENT DOCUMENTS

| | | |
|---|---|---|
| 604709 | 5/1960 | Italy . |
| 59-32758 | 2/1984 | Japan . |
| 284281 | 6/1928 | United Kingdom . |

OTHER PUBLICATIONS

Cryogenic Engineering, Chapter 2, "Liquefaction of Gases", Scott, Jul. 1959, (FIGS. 2.23–2.24, pp. 45–48).

Development of the Laminated Metal Heat Exchanger, vol. 32, No. 95, Aug. 1984, Takahashi et al, pp. 92–95.

*Primary Examiner*—Ronald C. Capossela

*Attorney, Agent, or Firm*—Oblon, Fisher, Spivak, McClelland & Maier

[57] ABSTRACT

A compact and easy-to-construct cylindrical counter-flow heat exchanger is provided for cryogenic refrigeration systems. It has an annular body, a helical pipe wound around and in contact with the annular body, and a sleeve which envelopes the helical pipe. A helical flow passage is formed around the annular body in contact with the helical pipe. A high-pressure fluid is introduced into a helical pipe, while a low-pressure fluid flows through the helical flow passage. Heat is exchanged between the two fluids through the helical pipe wall which is made of high heat-conductivity material such as copper.

18 Claims, 2 Drawing Sheets

CYLINDRICAL COUNTER-FLOW HEAT EXCHANGER

BACKGROUND OF THE INVENTION

1. Field of the Invention

This invention pertains to cylindrical counter-flow heat exchangers especially as used in cryogenic refrigeration systems.

2. Background of the Related Art

A cryogenic refrigeration system consisting of a combination of a displacer-expander refrigerator and a circulation loop with a Joule-Thomson valve and a cryogenic condenser is disclosed in U.S. Pat. No. 4,484,458. In such a refrigeration system, a counter-flow heat exchanger is used to exchange heat from a high-pressure, high-temperature fluid to a low-pressure, low-temperature fluid within the circulation loop. The counter-flow heat exchanger should be compactly arranged with the displacer-expander refrigerator, while heat loss should be minimized.

The counter-flow heat exchanger disclosed in said U.S. patent is a helical double-pipe wound around a refrigerator. A high-pressure fluid is introduced into the inner pipe, while a low-pressure fluid is introduced into the annulus region between the inner and the outer pipes. Such a double-pipe heat exchanger, however, is difficult to manufacture and does not have design flexibility with respect to variations in flow area and heat-transfer surface areas.

Another type of heat exchanger known as a laminated metal heat exchanger is also used as cryogenic counter-flow heat exchanger. High heat-conductivity plates and heat-insulating plates, both with holes for a high-pressure fluid and holes for a low-pressure fluid, are alternately stacked and bonded, so as to form separate high-pressure fluid paths and low-pressure fluid paths. This type of heat exchanger, however, is difficult to manufacture so as to provide complete sealing of the high-pressure fluid.

SUMMARY OF THE INVENTION

The object of this invention is to provide compact, easy-to-construct and reliable heat exchanger useful in a cryogenic refrigeration system.

In one embodiment, the heat exchanger of the invention is a cylindrical counter-flow heat exchanger having an annular body of low-heat conductivity material, a helical pipe of high conductivity for passage of high pressure fluid, the helical pipe being wound around and in contact with the annular body and annular covering means for enveloping the helical pipe. A helical flow passage for low-pressure fluid is defined at least in part by the outer-surfaces of the pipe and by the annular body.

In another embodiment, the heat exchanger of the invention is a cylindrical-counter-flow heat exchanger having an annular body of low heat conductivity material having a helical groove on its circumferential surface, a helical pipe of high heat-conductivity material for passage of high-pressure fluid wound in the groove in the annular body so as to form a helical flow passage in the groove for low-pressure fluid, and a covering means for enveloping the helical pipe.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
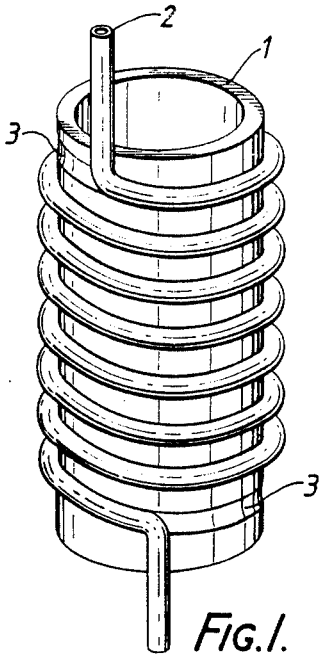
FIG. 1 is a perspective view of an embodiment of a heat exchanger according to the present invention with the sleeve and the covering member removed.
Figure 2:
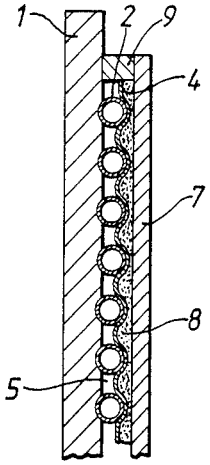
FIG. 2 is a partial sectional view of the heat exchanger shown in FIG. 1.
Figure 3:
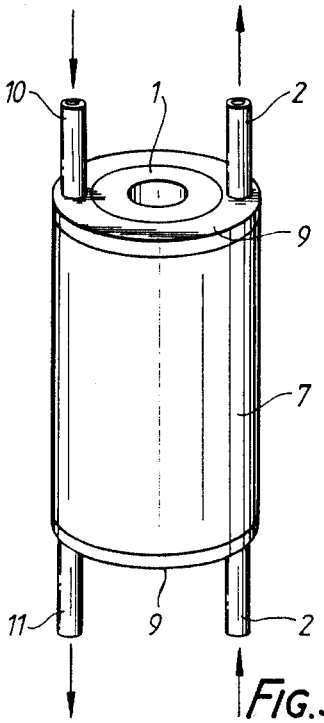
FIG. 3 is a perspective outer view of the heat exchanger shown in FIG. 1.

An embodiment of the present invention is shown in FIGS. 1, 2 and 3. Referring to FIG. 1, an annular or tubular body 1 is a hollow cylinder made of material of low heat-conductivity such as phenol-resin. A helical circular pipe 2 of high heat-conductivity material such as copper is wound around the annular body 1 and bonded by a bonding agent into a helical groove 3 provided on the circumferential surface of the annular body 1. The pitch of the helical groove 3 is set at least 1.5 times the outer diameter of the pipe 2.

As shown in FIG. 2, the helical circular pipe 2 is enveloped with a covering member 4 of low heat-conductivity material such a fluoro-resin. A helical flow passage 5 for low-pressure fluid is thus formed, the flow passage 5 being bounded by the annular body 1, the helical pipe 2 and the covering member 4.

The covering member 4 is surrounded by a sleeve 7. The sleeve 7 is, for example, a phenol resin pipe or a thin stainless steel pipe which has a low axial heat-transmission rate.

The sleeve 7 is mounted after the covering member 4 is form heat shrunk on the pipe 2. The annular gap formed between the sleeve 7 and the covering member 4 is then filled with bonding agent 8 such as epoxy-resin. Annular end plates 9 are mounted tight on the ends of annulus between the annular body 1 and the sleeve 7.

As shown in FIG. 3, a low-pressure fluid inlet pipe 10 and a low-pressure fluid outlet pipe 11 are mounted on the top and bottom end plates 9, respectively. The inlet and outlet pipes 10, 11 are connected to the helical flow passage 5 shown in FIG. 2. The openings in the end plates 9 penetrated by the pipes 2, 10, 11 are sealed with binding agent.

When the heat exchanger described above is used, a high-pressure fluid flows in one direction through the helical circular pipe 2, while a low-pressure fluid flows in the opposite direction through the helical flow passage 5. Heat is transferred from the high-pressure fluid in the pipe 2 to the low-pressure fluid in the flow passage 5, or vice-versa, via the high heat-conductivity pipe wall 2. The overall heat-transfer coefficient of the heat exchanger is high, as the two fluids flow in parallel (but countercurrent) and helical paths. The axial heat transfer rate within each fluid path relative to the axis of annular body 1 is very low owing to the helical structure of the two fluid paths and to the low heat-conductivity of the annular body 1 and the covering member 4. Since the high-pressure fluid flows in the circular pipe 2, fluid leakage is easily prevented. The construction of this heat exchanger is very easy, and the flow area and heat-transfer area can be easily adjusted by varying the pipe pitch, the pipe diameter, etc.

Different embodiments are shown in FIGS. 4–8. Common parts are assigned the same name and numeral, and their detailed descriptions are omitted.

Figure 4:
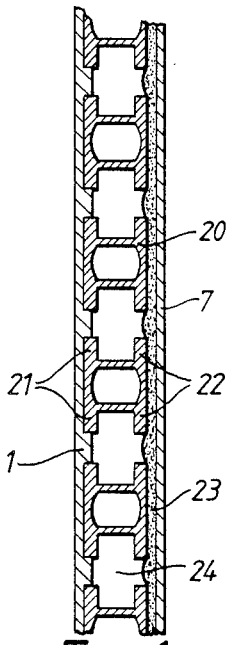
FIG. 4 is a partial sectional view of another embodiment of a heat exchanger of the invention.

In the embodiment shown in FIG. 4, the helical pipe 20 has two fins 21 along the annular body 1 and two fins 22 along the sleeve 7 and the covering member 4 is eliminated. A bonding agent layer 23 is formed between the pipe 20 and the sleeve 7. The helical flow passage 24 for low-pressure fluid has a larger heat-transfer area owing to the fins 21 and 22, whereas it does not have a larger surface friction area compared to the embodiment described in FIG. 2.

Figure 5:
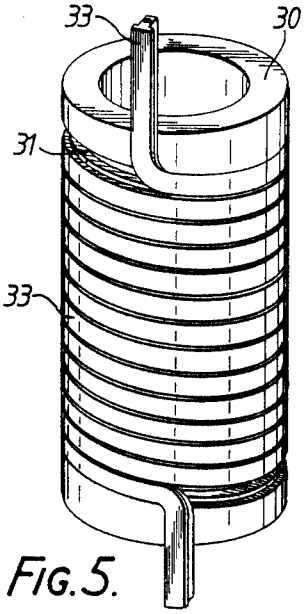
FIG. 5 is a perspective view of yet another embodiment of a heat exchanger according to the invention with the sleeve and the covering member removed.
Figure 6:
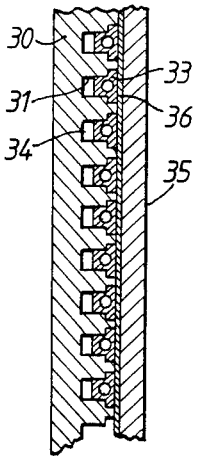
FIG. 6 is a partial sectional view of the heat exchanger shown in FIG. 5.

In the embodiment shown in FIGS. 5 and 6, an annular body 30 of low heat-conductivity has a two-stepped helical groove 31 on its circumferential surface. The central step of the groove 31 is deeper than its the peripheral step. A helical T-shaped pipe of high heat-conductivity material 33 is fitted into the groove 31 and bonded to the annular body 30 with bonding agent (not shown). A helical flow passage 34 is formed at the bottom of the groove 31. The outer surface of the pipe 33 is flush with outer surface of the annular body 30 which faces the inner surface of a sleeve 35, and a bonding agent layer 36 is positioned therebetween.

Figure 7:
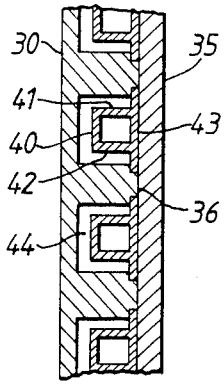
FIG. 7 is a partially sectioned view of yet another embodiment of a heat exchanger of the invention.

In the embodiment shown in FIG. 7, not only the inner side surface 40 but also the top surface 41 and the bottom surface 42 of the inner part of the helical pipe 43 face the helical flow passage 44 formed by the helical groove 31 in the annular body 30. In this embodiment, the heat-transfer area for the helical flow passage 44 is larger than that in the embodiment shown in FIG. 6.

Figure 8:
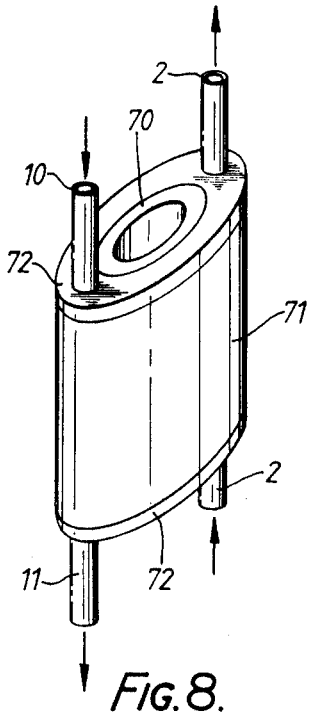
FIG. 8 is a perspective outer view of yet another embodiment of a heat exchanger of the invention.

In the embodiment shown in FIG. 8, the annular body 70 and the sleeve 71 are eliptical, so that the heat exchanger can be designed to be compact, and have oval end plates 72 penetrated by the helical pipe 2 and the low-pressure fluid inlet and outlet pipes 10 and 11.

In another embodiment (not shown), the helical pipe and the low-pressure fluid inlet and outlet pipes penetrate the sleeve instead of the end plates.

Figure 9:
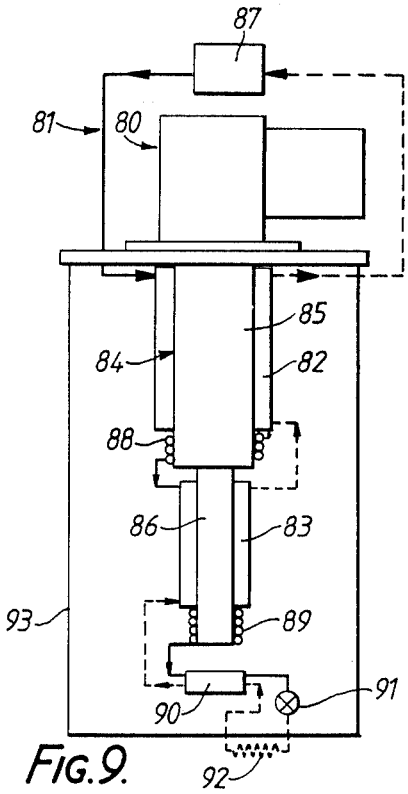
FIG. 9 is a schematic view of a cryogenic refrigerator system using heat exchangers of the invention.

FIG. 9 shows a schematic diagram of a cryogenic refrigeration system utilizing heat exchangers 82 and 83 of the present invention. A displacer-expander refrigerator 80 known as a Gifford-McMahon type refrigerator and a circulation loop 81 are mechanically coupled with the heat exchangers 82 and 83.

The refrigerator 80 has a cylindrical thin-walled container 84 which comprises a warmer stage 85 and a colder stage 86.

The circulation loop 81 has a compressor 87 arranged in the atmosphere to compress and drive the refrigerant such as helium gas in the loop 81. The high-pressure gas is represented by solid lines in FIG. 9, while the low pressure gas, by chain lines.

The helium gas compressed by the compressor 87 is fed to the heat exchanger 82 which surrounds the warmer stage 85 of the cylindrical container 84, where the compressed gas is cooled by the low-pressure gas which is returning to the compressor 87. The high-pressure gas cooled in the heat exchanger 82 is fed into a copper pipe 88 which is wound around the warmer stage 85.

The high-pressure gas is cooled in the pipe 88, and then fed into the heat exchanger 83 which surrounds the colder stage 86, where the high-pressure gas is further cooled by the low-pressure gas. The high-pressure gas cooled in the heat exchanger 83 is fed into another copper pipe 89 which is wound around the colder stage 86.

The higher-pressure gas is cooled in the pipe 89, and then fed into a Joule-Thomson heat exchanger 90, where the high-pressure gas is cooled by the low-pressure gas. The high-pressure gas cooled in the heat exchanger 90 is fed to a Joule-Thomson valve 91, where the gas expands and becomes low-pressure colder gas.

The gas is then fed into a condenser 92 which cools external helium gas and liquifies it. The low-pressure gas is sent back from the condenser 92 to the compressor 87 via the heat exchangers 90, 83 and 82, while gaining heat from the high-pressure gas.

The warmer stage 85, the colder stage 86, the heat exchangers 82, 83 and 90 and the Joule-Thomson valve 91 are arranged in a vacuum chamber 93 so as to minimize heat loss.

The construction of the heat exchangers 82 and 83 is the same as the embodiments described above. The annular bodies are arranged to be surrounding by and in contact with the cylindrical container 84. Therefore, the annular bodies strengthen the thin-walled container 84, and the whole refrigeration system can be designed to be compact.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A cylindrical counter-flow heat exchanger comprising:
   (a) an annular body formed of low heat-conductivity material;
   (b) a helical pipe for high-pressure fluid formed of high-conductivity material and wound around and in contact with said annular body; and
   (c) annular covering means for enveloping said helical pipe, wherein a helical flow passage for low-pressure fluid is formed outside said helical pipe, said helical flow passage being confined by said helical pipe, said annular body and said annular covering means.

2. The heat exchanger according to claim 1, wherein said annular body has a circumferential exterior surface with a helical groove therein, and wherein said helical pipe is fitted into said groove.

3. The heat exchanger according to claim 2 wherein said helical groove and said helical pipe are matingly stepped and wherein said helical flow passage is formed by a portion of said helical groove into which said helical pipe does not extend 4. The heat exchanger of claim 3 wherein said helical pipe is flush with said circumferential surface of said annular body.

5. The heat exchanger according to claim 1, wherein said annular covering means comprises a covering member of a material which contracts on exposure to heat, a cylindrical sleeve which surrounds said covering member, and a bonding agent layer provided in an annular gap between said sleeve and said covering member.

6. The heat exchanger according to claim 5, wherein said cylindrical sleeve is a thin stainless steel pipe.

7. The heat exchanger according to claim 1, wherein said annular covering means comprises a cylindrical sleeve which envelopes said helical pipe, and a bonding agent layer provided between said helical pipe and said cylindrical sleeve.

8. The heat exchanger according to claim 1, wherein said helical pipe has at least one fin in contact with said annular body.

9. The heat exchanger according to claim 1, wherein said helical pipe has at least one fin in contact with said covering means.

10. The heat exchanger according to claim 1 including means for flowing a high-pressure fluid through said helical pipe and means for flowing a low pressure fluid through said helical flow passage countercurrent to said high-pressure fluid flowing through said helical pipe.

11. The heat exchanger of claim 1, in combination with a displacer-expander type refrigerator having cylindrical warmer and colder stages, wherein one of said stages is fitted in said annular body.

12. A helical counter-flow heat exchanger comprising:

(a) an annular body formed of low heat-conductivity material and having a helical groove in a circumferential surface thereof;

(b) a helical pipe for passage of high-pressure fluid formed of high heat-conductivity material and wound in said groove in said annular body so as to define a helical flow passage for low-pressure fluid in said groove outside said helical pipe; and (c) annular covering means for enveloping said helical pipe.

13. The heat exchanger according to claim 12, wherein said covering means comprises a cylindrical sleeve which envelopes said helical pipe and said annular body, and a bonding agent layer provided between said annular body and said cylindrical sleeve.

14. The heat exchanger according to claim 13, wherein said cylindrical sleeve is a thin stainless steel pipe.

15. The heat exchanger according to claim 12 including means for flowing a high-pressure fluid through said helical pipe and means for flowing a low pressure fluid through said helical flow passage countercurrent to said high-pressure fluid flowing through said helical pipe.

16. The heat exchanger according to claim 12 wherein said helical groove and said helical pipe are matingly stepped and wherein said helical flow pasage is formed by a portion of said helical groove into which said helical pipe does not extend.

17. The heat exchanger of claim 12 wherein said helical pipe is flush with said circumferential surface of said annular body.

18. The heat exchanger of claim 12, in combination with a displacer-expander type refrigerator having cylindrical warmer and colder stages, wherein one of said stages is fitted in said annular body.

* * * * *